US012152394B2

(12) United States Patent
Villasana Cortez

(10) Patent No.: US 12,152,394 B2
(45) Date of Patent: Nov. 26, 2024

(54) DRYWALL CORNER ASSEMBLY

(71) Applicant: Omar Villasana Cortez, Jackson, WY (US)

(72) Inventor: Omar Villasana Cortez, Jackson, WY (US)

( * ) Notice: Subject to any disclaimer, the term of this patent is extended or adjusted under 35 U.S.C. 154(b) by 342 days.

(21) Appl. No.: 17/737,583

(22) Filed: May 5, 2022

(65) Prior Publication Data

US 2023/0358059 A1 Nov. 9, 2023

(51) Int. Cl.
*E04F 21/00* (2006.01)
*E04F 13/06* (2006.01)

(52) U.S. Cl.
CPC ..... *E04F 21/0053* (2013.01); *E04F 13/06* (2013.01); *E04F 2013/063* (2013.01)

(58) Field of Classification Search
CPC . E04F 21/0053; E04F 13/06; E04F 2013/063; E04F 13/0733; E04F 13/14; E04F 19/064
See application file for complete search history.

(56) References Cited

U.S. PATENT DOCUMENTS 1,804,564 A * 5/1931 Mcchesney ..... E04F 13/06 52/255
3,712,003 A * 1/1973 Hallock ..... E04F 19/028 52/309.1
4,852,318 A * 8/1989 Anderson ..... E04F 19/028 52/288.1
5,544,463 A 8/1996 Bergin
5,752,353 A * 5/1998 Koenig ..... E04F 13/06 52/287.1
5,836,123 A 11/1998 Gulino
6,148,573 A 11/2000 Smythe, Jr.
6,779,313 B2 8/2004 Smythe, Jr.
D754,886 S 4/2016 Koenig, Jr.
9,303,413 B2 * 4/2016 Koenig, Jr. ..... E04F 19/022
9,388,582 B1 * 7/2016 Smythe ..... E04F 13/068
9,446,546 B1 9/2016 Wambaugh
2002/0083665 A1 * 7/2002 Razetto ..... E04F 19/02 52/287.1
2004/0060252 A1 * 4/2004 Daly, IV ..... E04F 19/064 52/312
2005/0257461 A1 * 11/2005 Daly ..... E04F 19/064 52/254
2006/0236626 A1 10/2006 Smythe
(Continued)

FOREIGN PATENT DOCUMENTS

WO WO9714856 4/1997

*Primary Examiner* — Patrick J Maestri

(57) ABSTRACT

A drywall corner assembly includes a trim unit that has a first portion which is perpendicularly oriented with a second portion thereby facilitating the trim unit to be installed on an outside corner of a framed wall intended for receiving drywall installation. A pair of screw plates is each integrated into a respective one of the first portion and the second portion of the trim unit to accommodate a fastener for attaching the trim unit to framing members of the framed wall. A sheet is bonded to the trim unit and the sheet extends substantially across each of the first portion and the second portion of the trim unit. The sheet is aligned with an exposed surface of drywall installed on the framed wall to facilitate joint compound to be laid between the drywall and the sheet.

7 Claims, 7 Drawing Sheets

(56) References Cited

U.S. PATENT DOCUMENTS

| | | | | |
|---|---|---|---|---|
| 2008/0083179 | A1* | 4/2008 | Riggs | E04F 13/06 52/287.1 |
| 2017/0314274 | A1 | 11/2017 | Rosenthal | |
| 2021/0355692 | A1* | 11/2021 | Jöneman | E04F 13/06 |

* cited by examiner

DRYWALL CORNER ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to drywall devices and more particularly pertains to a new drywall device for forming a precise corner during drywall installation. The device includes a trim unit that forms a perpendicular angle and a pair of screw plates each extending away in opposing directions from the trim unit. The device includes a sheet that is bonded to the trim unit and which is aligned with an exposed edge of drywall positioned adjacent to the trim unit to facilitate joint compound to be applied between the drywall and the trim unit.

(2) Description of Related Art Including Information Disclosed Under 37 CFR 1.97 and 1.98

The prior art relates to drywall devices including a prefinished corner bead assembly that includes a bull-nosed protrusion. The prior art discloses a vinyl-siding corner block that includes a pair of mounting tabs that each extend laterally away from the corner block and a plurality of mounting holes. The prior art discloses a pre-formed corner trim device that includes a pair of a pair of semi-rigid members which form a perpendicular angle and which taper to a thin edge. The prior art discloses a corner bead assembly which has a protruding nose to facilitate joint compound to be applied on a corner. The prior art discloses a corner trim device that is designed to bond with a variety of joint compounds. The prior art discloses a corner bead that is resiliently bendable to shape the corner bead to a variety of angles. The prior art discloses a trim strip assembly that includes an adhesive layer for adhering to a framed corner. The prior art discloses an ornamental design for a corner trim assembly that includes a pair of foraminous nail plates and a pair of ridges each extending along a respective foraminous nail plate.

(h) BRIEF SUMMARY OF THE INVENTION

An embodiment of the disclosure meets the needs presented above by generally comprising a trim unit that has a first portion which is perpendicularly oriented with a second portion thereby facilitating the trim unit to be installed on an outside corner of a framed wall intended for receiving drywall installation. A pair of screw plates is each integrated into a respective one of the first portion and the second portion of the trim unit to accommodate a fastener for attaching the trim unit to framing members of the framed wall. A sheet is bonded to the trim unit and the sheet extends substantially across each of the first portion and the second portion of the trim unit. The sheet is aligned with an exposed surface of drywall installed on the framed wall to facilitate joint compound to be laid between the drywall and the sheet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
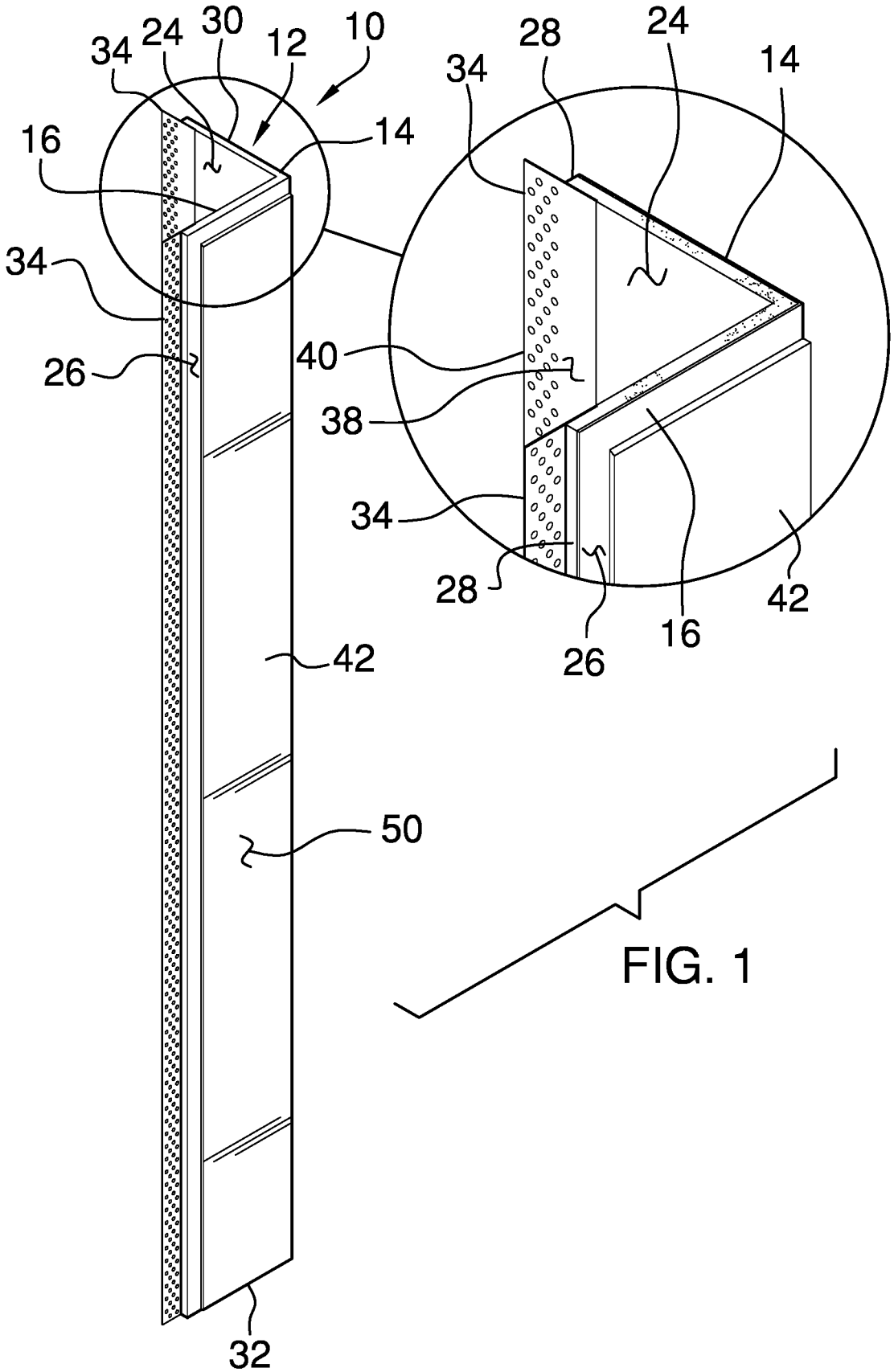
FIG. 1 is a perspective view of a drywall corner assembly according to an embodiment of the disclosure.
Figure 2:
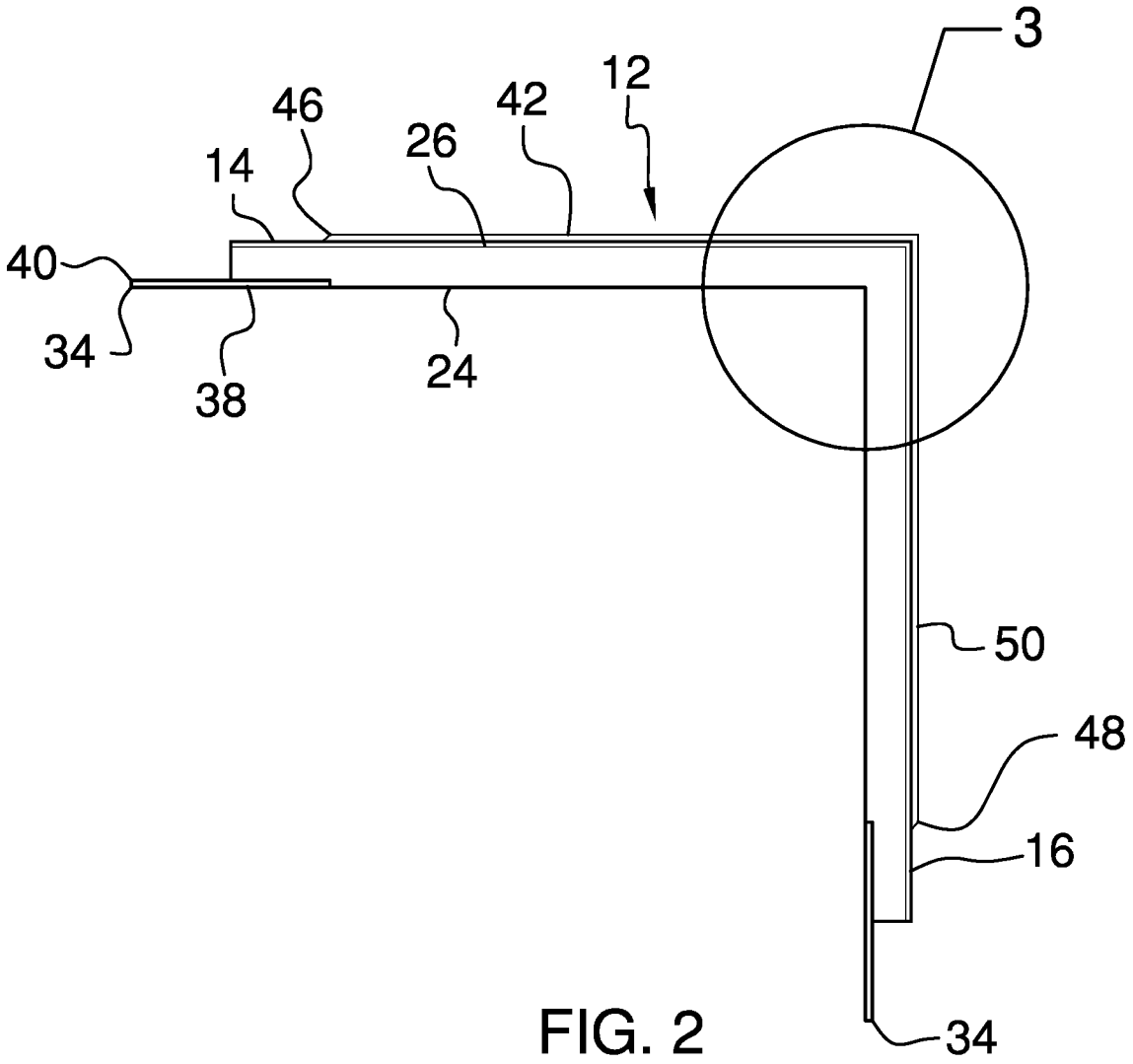
FIG. 2 is a top view of an embodiment of the disclosure.

With reference now to the drawings, and in particular to FIGS. 1 through 7 thereof, a new drywall device embodying the principles and concepts of an embodiment of the disclosure and generally designated by the reference numeral 10 will be described.

As best illustrated in FIGS. 1 through 7, the drywall corner assembly 10 generally comprises a trim unit 12 that has a first portion 14 which is perpendicularly oriented with a second portion 16 such that the trim unit 12 defines an outside corner. In this way the trim unit 12 can be installed on an outside corner 18 of a framed wall 20 intended for receiving drywall installation. The framed wall 20 may be an interior wall of a house, for example, or other wall that is commonly finished with drywall. Each of the first portion 14 and the second portion 16 has a back surface 24, a front surface 26 and an outward edge 28, and the back surface 24 of the first portion 14 lies on a plane which forms a perpendicular angle with the back surface 24 of the second portion 16. Furthermore, the front surface 26 of the first portion 14 lies on a plane forming a 270.0 degree angle with the front surface 26 of the second portion 16. The trim unit 12 has a top end 30 and a bottom end 32, and the trim unit 12 is elongated between the top end 30 and the bottom end 32 to a length that is equivalent to common heights of framed walls in the construction industry.

A pair of screw plates 34 is each attached to and extends away from a respective one of the first portion 14 and the second portion 16 of the trim unit 12. Each of the screw plates 34 is foraminous thereby facilitating each of the screw plates 34 to accommodate a fastener 36 for attaching the trim unit 12 to framing members of the framed wall 20. Each of the screw plates 34 has a rear surface 38 and an outward edge 40, and each of the screw plates 34 is integrated into the back surface 24 of the respective first portion 14 or the second portion 16. In this way the rear surface 38 of each of the screw plates 34 lies on a plane that is oriented coplanar with the rear surface 38 of the respective first portion 14 or the second portion 16 thereby facilitating the rear surface 38 of the first portion 14 and the second portion 16 to lie flat against the framing members of the framed wall 20. Each of the screw plates 34 extends between the top end 30 and the bottom end 32 of the trim unit 12. Additionally, each of the screw plates 34 extends outwardly beyond the outward edge 28 of the respective first portion 14 and the second portion 16. In this way the outward edge 40 of each of the screw plates 34 is spaced from and is oriented parallel with the outward edge 28 of the respective first portion 14 and the second portion 16.

A sheet 42 is bonded to the trim unit 12 and the sheet 42 extends substantially across each of the first portion 14 and the second portion 16 of the trim unit 12. In this way the sheet 42 can be aligned with an exposed surface 44 of drywall 22 installed on the framed wall 20 to facilitate joint compound 45 to be laid between the drywall 22 and the sheet 42. The sheet 42 may comprise drywall paper or other type of material that is similar to facing that is installed on the drywall 22. The sheet 42 has a first edge 46, a second edge 48 and an exposed surface 50 with respect to the front surface 26 of the first portion 14 and the second portion 16 of the trim unit 12.

The first edge 46 is spaced from and is oriented parallel with the outward edge 28 of the first portion 14 of the trim unit 12, and the second edge 48 is spaced from and is oriented parallel with the outward edge 28 of the second portion 16 of the trim unit 12. Each of the first edge 46 and the second edge 48 is beveled to angle outwardly between the exposed surface 50 of the sheet 42 and the front surface 26 of the respective first portion 14 and the second portion 16. In this way joint compound 45 applied between the drywall 22 and the sheet 42 can be cleanly finished between the drywall 22 and the exposed surface of the sheet 42.

Figure 3:
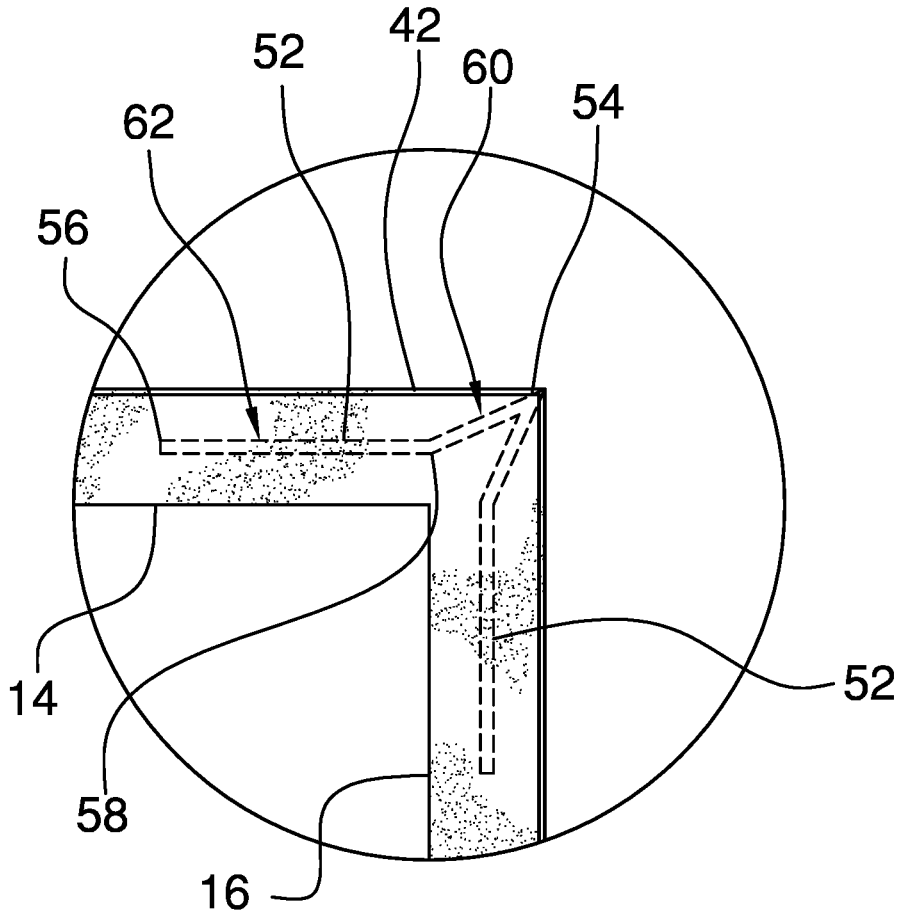
FIG. 3 is a detail view taken from circle 3 of FIG. 2 of an embodiment of the disclosure.
Figure 4:
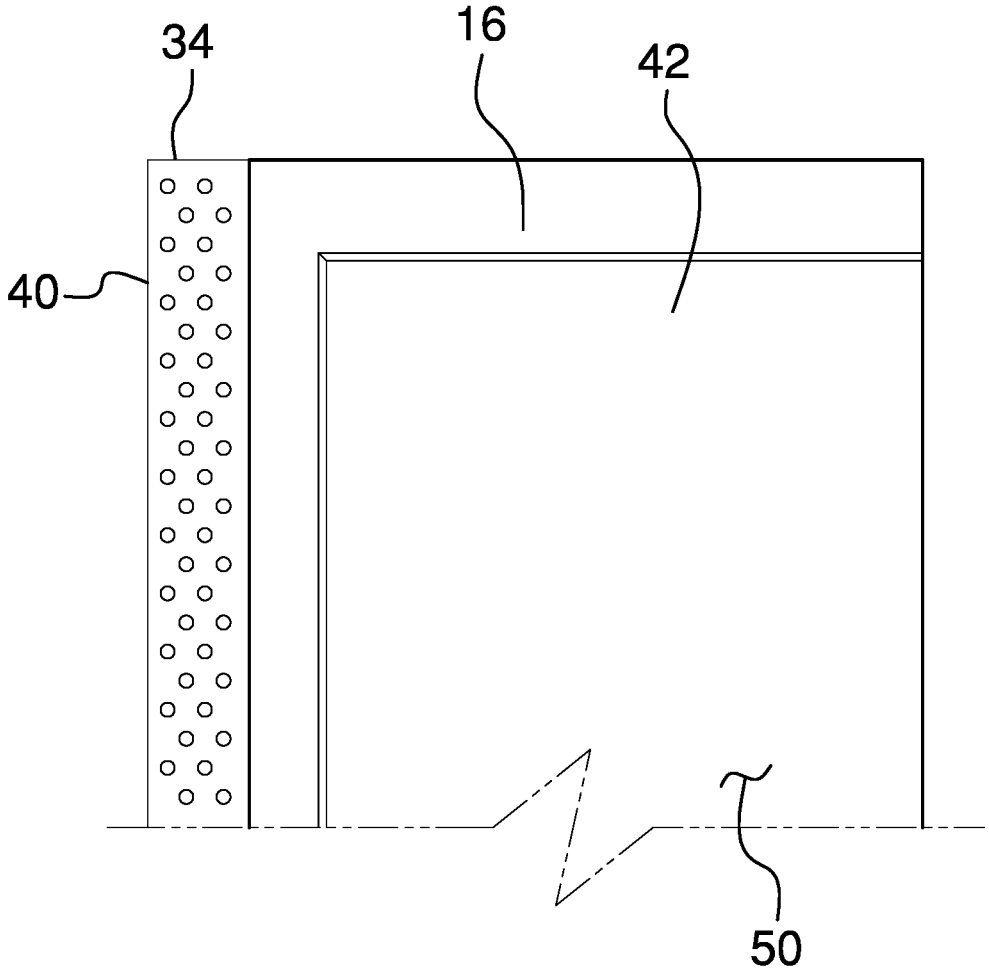
FIG. 4 is a right side view of an embodiment of the disclosure.
Figure 5:
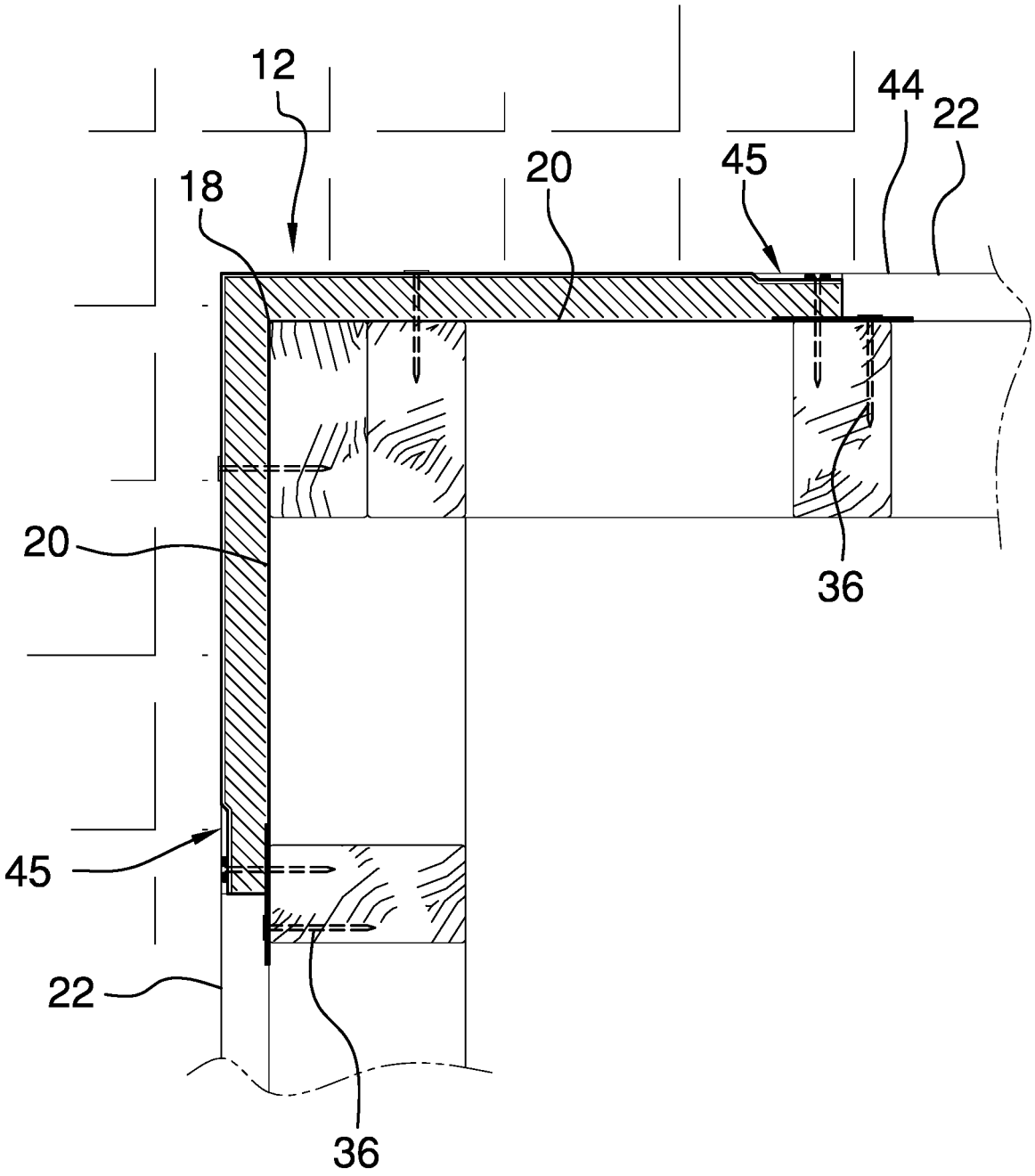
FIG. 5 is a perspective in-use view of an embodiment of the disclosure.

As is most clearly shown in FIG. 3, a pair of members 52 is provided and each of the members 52 is integrated within a respective one of the first portion 14 and the second portion 16 of the trim unit 12. Each of the members 52 is comprised of a resilient material thereby facilitating the members 52 to retain the trim unit 12 in a perpendicular orientation. Each of the members 52 has a primary edge 54 and a secondary edge 56, and the primary edge 54 of each of the members 52 intersects each other at an intersection between the first portion 14 and the second portion 16 of the trim unit 12. Furthermore, each of the members 52 has a bend 58 that is positioned between the primary edge 54 and the secondary edge 56 to define a primary section 60 angling away from the intersection between the first portion 14 and the second portion 16 of the trim unit 12. Additionally, the bend 58 in each of the members 52 defines a secondary section 62 extending toward the outward edge 28 of the first portion 14 and the second portion 16 of the trim unit 12.

Figure 6:
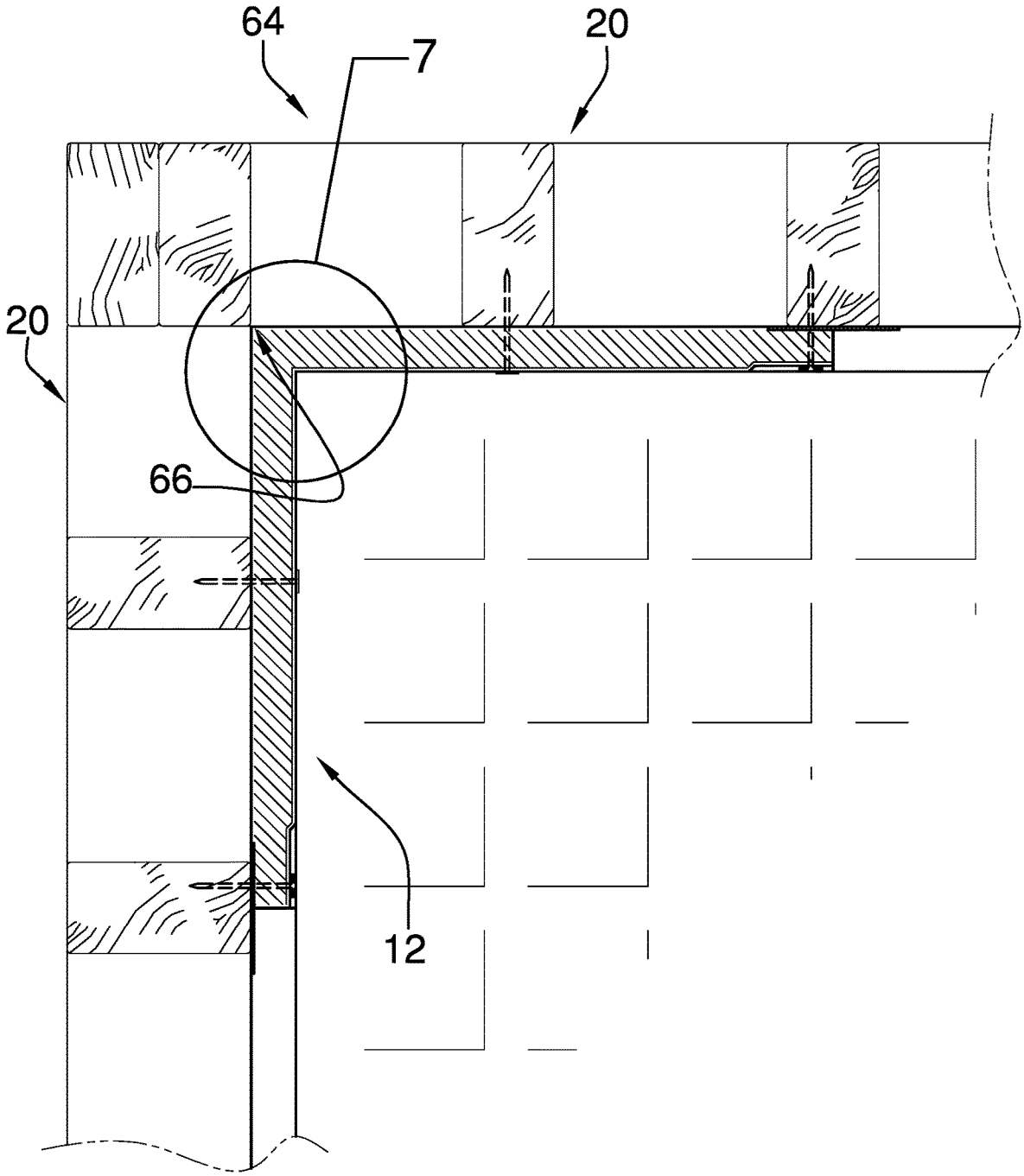
FIG. 6 is a perspective in-use view of an alternative embodiment of the disclosure.
Figure 7:
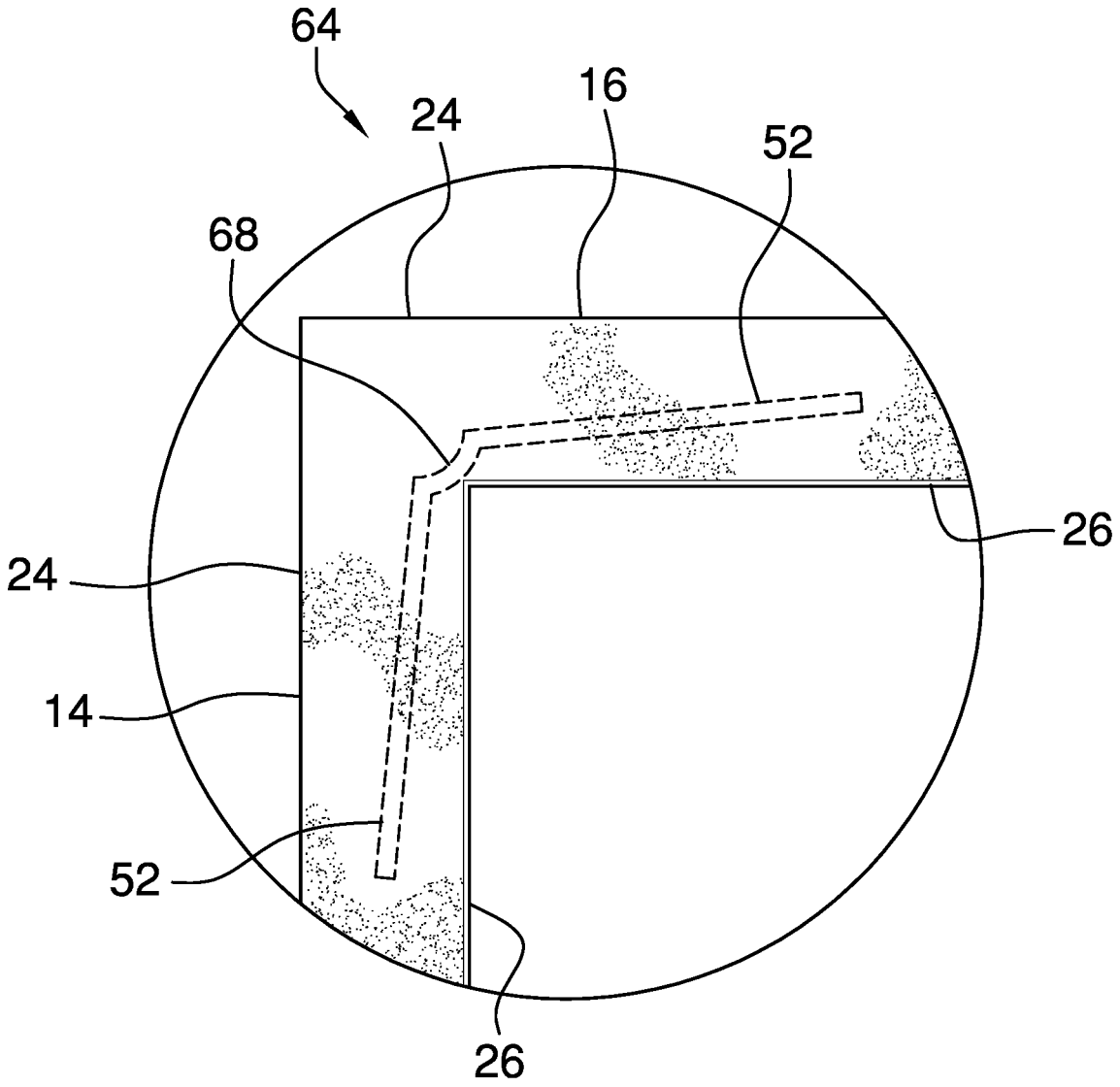
FIG. 7 is a detail view taken from circle 7 of FIG. 6 of an embodiment of the disclosure.

In an alternative embodiment 64 as is most clearly shown in FIGS. 6 and 7, the back surface 24 of the first portion 14 of the trim unit 12 forms a 270.0 degree angle with the back surface 24 of the second portion 16. Additionally, the front surface 26 of the first portion 14 forms a perpendicular angle with the front surface 26 of the second portion 16. In this way the trim unit 12 can be installed on an inside corner 66 of a pair of framed walls 20. Continuing in the alternative embodiment 64, each of the members 52 angles away from a central panel 68. The central panel 68 curves between the pair of members 52 such that each of the members 52 angles away from the front surface 26 of the respective first portion 14 and second portion 16 of the trim unit 12. Furthermore, the central panel 68 is aligned with an intersection between first portion 14 and the second portion 16 of the trim unit 12.

In use, the trim unit 12 is positioned on the outside corner 18 of the framed wall prior to installing drywall 22 on the framed wall 20. Fasteners 36, such as framing nails or screws, are extended through the screw plates 34 to secure the trim unit 12 to the outside corner 18. In this way the exposed surface 44 of drywall 22 that is installed on the framed wall 20 is aligned with the exposed surface 50 of the sheet 42 on the trim unit 12. Joint compound 45 is applied between the drywall 22 and the sheet 42 and the joint compound 45 is sanded once the joint compound 45 dries. In this way the trim unit 12 facilitates a precise corner to be formed in a more timely and efficient manner as compared to the traditional method of forming a corner during drywall installation which involves applying multiple coats of joint compound 45 and shaping the joint compound 45 to form a precise corner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drywall corner assembly for finishing an outside corner of a wall during installation of drywall on the wall, said assembly comprising:

a trim unit having a first portion being perpendicularly oriented with a second portion such that said trim unit defines an outside corner wherein said trim unit is configured to be installed on an outside corner of a framed wall intended for receiving drywall installation;

a pair of screw plates, each of said screw plates being attached to and extending away from a respective one of said first portion and said second portion of said trim unit, each of said screw plates being foraminous wherein each of said screw plates is configured to accommodate a fastener for attaching said trim unit to framing members of the framed wall;

a sheet being bonded to said trim unit, said sheet extending substantially across each of said first portion and said second portion of said trim unit wherein said sheet is configured to align with an exposed surface of drywall installed on the framed wall to facilitate joint compound to be laid between the drywall and said sheet;

wherein each of said first portion and said second portion has a back surface, a front surface and an outward edge, said back surface of said first portion lying on a plane forming a perpendicular angle with said back surface of said second portion, said front surface of said first portion lying on a plane forming a 270.0 degree angle with said front surface of said second portion, said trim unit having a top end and a bottom end, said trim unit being elongated between said top end and said bottom end; and a pair of members, each of said members being integrated within a respective one of said first portion and said second portion of said trim unit, each of said members being comprised of a resilient material wherein said members are configured to retain said trim unit in a perpendicular orientation.

2. The assembly according to claim 1, wherein:

each of said screw plates has a rear surface and an outward edge, each of said screw plates being integrated into said back surface of said respective first portion or said second portion such that said rear surface of each of said screw plates lies on a plane being oriented coplanar with said rear surface of said respective first portion or said second portion wherein said rear surface of said first portion and said second portion are configured to lie flat against the framing members of the framed wall;

each of said screw plates extends between said top end and said bottom end of said trim unit; and each of said screw plates extends outwardly beyond said outward edge of said respective first portion and said second portion such that said outward edge of each of said screw plates is spaced from and is oriented parallel with said outward edge of said respective first portion and said second portion.

3. The assembly according to claim 1, wherein said sheet has a first edge, a second edge and an exposed surface with respect to said front surface of said first portion and said second portion of said trim unit, said first edge being spaced from and being oriented parallel with said outward edge of said first portion of said trim unit, said second edge being spaced from and being oriented parallel with said outward edge of said second portion of said trim unit.

4. The assembly according to claim 1, wherein each of said members has a primary edge and a secondary edge, said primary edge of each of said members intersecting each other at an intersection between said first portion and said second portion of said trim unit, each of said members having a bend being positioned between said primary edge and said secondary edge to define a primary section angling away from said intersection between said first portion and said second portion of said trim unit, said bend in each of said members defining a secondary section extending toward said outward edge of said first portion and said second portion of said trim unit.

5. A drywall corner assembly for finishing an outside corner of a wall during installation of drywall on the wall, said assembly comprising:

a trim unit having a first portion being perpendicularly oriented with a second portion such that said trim unit defines an outside corner wherein said trim unit is configured to be installed on an outside corner of a framed wall intended for receiving drywall installation;

a pair of screw plates, each of said screw plates being attached to and extending away from a respective one of said first portion and said second portion of said trim unit, each of said screw plates being foraminous wherein each of said screw plates is configured to accommodate a fastener for attaching said trim unit to framing members of the framed wall;

a sheet being bonded to said trim unit, said sheet extending substantially across each of said first portion and said second portion of said trim unit wherein said sheet is configured to align with an exposed surface of drywall installed on the framed wall to facilitate joint compound to be laid between the drywall and said sheet;

wherein each of said first portion and said second portion has a back surface, a front surface and an outward edge, said back surface of said first portion lying on a plane forming a perpendicular angle with said back surface of said second portion, said front surface of said first portion lying on a plane forming a 270.0 degree angle with said front surface of said second portion, said trim unit having a top end and a bottom end, said trim unit being elongated between said top end and said bottom end;

wherein said sheet has a first edge, a second edge and an exposed surface with respect to said front surface of said first portion and said second portion of said trim unit, said first edge being spaced from and being oriented parallel with said outward edge of said first portion of said trim unit, said second edge being spaced from and being oriented parallel with said outward edge of said second portion of said trim unit; and wherein each of said first edge and said second edge is beveled to angle outwardly between said exposed surface of said sheet and said front surface of said respective first portion and said second portion wherein said first edge and said second edge are each configured for joint compound to be cleanly finished between the drywall and said exposed surface of said sheet.

6. A drywall corner assembly for finishing an outside corner of a wall during installation of drywall on the wall, said assembly comprising:

a trim unit having a first portion being perpendicularly oriented with a second portion such that said trim unit defines an outside corner wherein said trim unit is configured to be installed on an outside corner of a framed wall intended for receiving drywall installation, each of said first portion and said second portion having a back surface, a front surface and an outward edge, said back surface of said first portion lying on a plane forming a perpendicular angle with said back surface of said second portion, said front surface of said first portion lying on a plane forming a 270.0 degree angle with said front surface of said second portion, said trim unit having a top end and a bottom end, said trim unit being elongated between said top end and said bottom end;

a pair of screw plates, each of said screw plates being attached to and extending away from a respective one of said first portion and said second portion of said trim unit, each of said screw plates being foraminous wherein each of said screw plates is configured to accommodate a fastener for attaching said trim unit to framing members of the framed wall, each of said screw plates having a rear surface and an outward edge, each of said screw plates being integrated into said back surface of said respective first portion or said second portion such that said rear surface of each of said screw plates lies on a plane being oriented coplanar with said rear surface of said respective first portion or said second portion wherein said rear surface of said first portion and said second portion are configured to lie flat against the framing members of the framed wall, each of said screw plates extending between said top end and said bottom end of said trim unit, each of said screw plates extending outwardly beyond said outward edge of said respective first portion and said second portion such that said outward edge of each of said screw plates is spaced from and is oriented parallel with said outward edge of said respective first portion and said second portion;

a sheet being bonded to said trim unit, said sheet extending substantially across each of said first portion and said second portion of said trim unit wherein said sheet is configured to align with an exposed surface of drywall installed on the framed wall to facilitate joint compound to be laid between the drywall and said sheet, said sheet having a first edge, a second edge and an exposed surface with respect to said front surface of said first portion and said second portion of said trim unit, said first edge being spaced from and being oriented parallel with said outward edge of said first portion of said trim unit, said second edge being spaced from and being oriented parallel with said outward edge of said second portion of said trim unit, each of said first edge and said second edge being beveled to angle outwardly between said exposed surface of said sheet and said front surface of said respective first portion and said second portion wherein said first edge and said second edge are each configured for joint compound applied between the drywall and said sheet to be cleanly finished between the drywall and said exposed surface of said sheet; and a pair of members, each of said members being integrated within a respective one of said first portion and said second portion of said trim unit, each of said members being comprised of a resilient material wherein said members are configured to retain said trim unit in a perpendicular orientation, each of said members having a primary edge and a secondary edge, said primary edge of each of said members intersecting each other at an intersection between said first portion and said second portion of said trim unit, each of said members having a bend being positioned between said primary edge and said secondary edge to define a primary section angling away from said intersection between said first portion and said second portion of said trim unit, said bend in each of said members defining a secondary section extending toward said outward edge of said first portion and said second portion of said trim unit.

7. The assembly according to claim 6, wherein:

said back surface of said first portion of said trim unit forms a 270.0 degree angle with said back surface of said second portion; and said front surface of said first portion forms a perpendicular angle with said front surface of said second portion.

* * * * *